United States Patent [19]

Osaka

[11] Patent Number: 4,660,022

[45] Date of Patent: Apr. 21, 1987

[54] SYSTEM FOR GUIDING THE BLIND

[76] Inventor: Takeshi Osaka, 439-18, Kitairiso, Sayama-City, Saitama-Prefecture, Japan

[21] Appl. No.: 665,772

[22] Filed: Oct. 29, 1984

[30] Foreign Application Priority Data

Dec. 6, 1983 [JP] Japan ..... 58-229113

[51] Int. Cl.[4] ..... G08B 3/10

[52] U.S. Cl. ..... 340/407; 342/24

[58] Field of Search ..... 340/407, 944, 988, 996, 340/19 A, 21; 343/5 BL, 6.5 SS, 116; 369/21, 22; 342/24; 135/DIG. 11; 367/19, 95, 107, 116, 900, 910

[56] References Cited

U.S. PATENT DOCUMENTS

| | | | |
|---|---|---|---|
| 3,718,896 | 2/1973 | Mowat | 343/5 BL |
| 3,987,403 | 10/1976 | Smith | 343/5 BL |
| 3,996,950 | 12/1976 | Mier | 340/407 |
| 4,025,922 | 5/1977 | Trawick, III | 340/407 |
| 4,253,083 | 2/1981 | Imamura | 340/944 |
| 4,280,204 | 7/1981 | Elchinger | 343/5 BL |
| 4,400,786 | 8/1983 | Mandel et al. | 340/19 A |

*Primary Examiner*—John W. Caldwell, Sr.
*Assistant Examiner*—Mahmoud Fatahi-Yar
*Attorney, Agent, or Firm*—Kane, Dalsimer, Kane, Sullivan and Kurucz

[57] ABSTRACT

A system for guiding the blind including at least one receiver/sound generator unit having a built-in sound generator giving information on the destination of the user, and a receiver for actuating the sound generator in accordance with a control signal coming from outside, and a transmitter/control unit carried by the user for producing the control signal. As the user carrying the transmitter/control unit and approaching the destination at which the receiver/sound generator unit is installed, the user actuates the transmitter/control unit to cause it to produce a control signal which actuates the sound generator of the receiver/sound generator whereby an audio signal representing a voice, an onomatopoeic sound, a chime, etc., is produced to guide the user to the destination.

4 Claims, 3 Drawing Figures

SYSTEM FOR GUIDING THE BLIND

BACKGROUND OF THE INVENTION

This invention relates to a system for guiding the blind for aiding those who have lost eyesight in reaching destinations without any trouble, such as visiting friends and public institutions, including government offices, banks, post offices, etc., by using an electronic guiding system.

Various attempts have been made to aid the blind. For example, the provision of guide plates having surface irregularities has become popular. The plates are placed at pedestrian crossings, railroad station platforms and passageways in public places. Traffic signals which produce musical sound for the blind have been also developed and installed in various busy intersection street corners. A device for continuously sounding a chime or ringing a bell has been developed for calling the attention of the blind that they are approaching street corners near schools for the blind or libraries offering books in braille where the blind are expected in a large number.

The facilities noted hereinabove for guiding the blind are undoubtedly a great help to the blind and their contribution to the promotion of the welfare of the handicapped is inestimable. However, they leave something to be desired. The guide plates are rather passive means for guiding the blind and they only play the role of enabling the blind to move around without any trouble. The traffic signal for the blind is means for ensuring that the blind can cross the street without any accident. It is true that the device for continuously sounding a chime or ringing a bell is undoubtedly a great help to the blind, like the traffic signals for the blind. However, one must admit that these devices merely perform the function of directing the blind at street corners or on station platforms, and that they are unable to guide the blind to specific destinations including public and private buildings and facilities. Inability of the devices of the prior art designed to guide the blind and direct them to their destination has cause immeasurable inconveniences and anxiety to the blind especially when they are near their destinations but lack the means of identifying the same.

SUMMARY OF THE INVENTION

The object of this invention is to provide a system for guiding the blind which is capable of guiding them to their destinations without any trouble, like a beacon which guides an airplane.

To accomplish this objective, the system is comprised of at least one receiver/sound generator unit including sound generator means for reproducing a predetermined signal which is actuated by a control signal to produce sound, and a portable transmitter/control unit for producing control signals for actuating the receiver/sound generator unit.

Accordingly, the system for guiding the blind is capable of alleviating the uneasiness of the blind and ensuring that they will reach their destinations safely and in a shorter amount of time.

In addition, other features and advantages of the invention will become apparent from the description set forth herewith when considered in conjunction with the accompanying drawings.

DESCRIPTION OF THE PREFERRED EMBODIMENT

Figure 1:
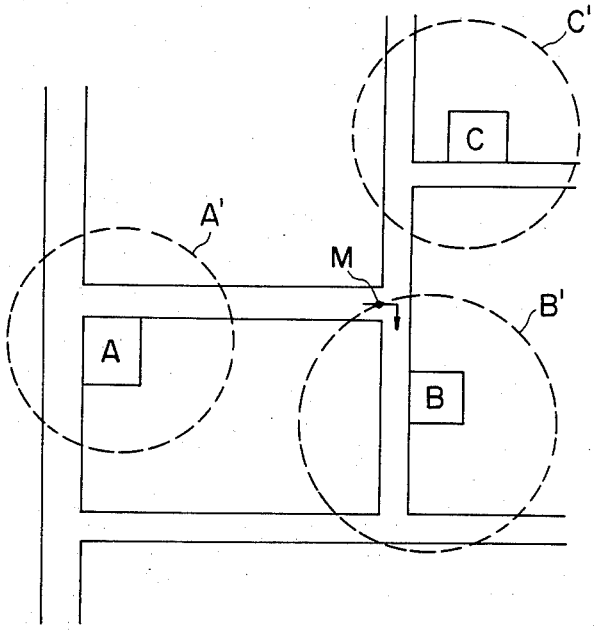
FIG. 1 is a diagram explaining the manner in which the system for guiding the blind is used according to the invention.

FIG. 1 is a diagram explaining the manner in which the system for guiding the blind according to the invention function, In FIG. 1, three destinations A, B and C are located in arbitrarily selected positions for the blind to visit. According to the invention, the destination A, B and C are each provided with a receiver/sound generator unit. The receiver/sound generator units receive control signals, which may be in the form of a radio wave, and produce sound of a predetermined content several times. The predetermined content of the sound is stored in a memory built in the receiver/sound generator unit and repeatedly reproduced for a suitable number of times. The sound may be a human voice announcing "this is A (or B or C)" or chirping of some little birds. The receiver/sound generator units are secured to suitable locations as the destinations A, B and C. The locations serving as the destinations A, B and C may be arbitrarily selected and no limits are placed on them. For example, they may include, besides the homes of the blind, public and private institutions, such as local government offices, post offices, banks, schools, police stations, shops, supermarkets, bus stops and railroad stations, taxi stands.

The blind person carries with him or her a portable transmitter/control unit in which the receiver/sound generator unit is installed which selectively produces a radio wave of a frequency corresponding to the receiver section of the receiver/sound generator unit. Assume that the person carrying the transmitter/control unit wants to reach destination B, for example. The user actuates the transmitter/control unit when he is sure that he is within the range of a phantom line circle B′ corresponding to the range of the receiver at destination B. The transmitter/control unit produces a radio control signal of a preselected frequency which actuates the receiver/sound generator unit at destination B and causes it to perform a predetermined operation several times. For example, the unit at B may be a pulse-coded verbal message, or a non-verbal message such as birds chirping, as mentioned above. Thus, the user can reach the destination B without any trouble by following the sound to its source. Unless the user of the system is a total stranger to the destination he wishes to reach, he should be able to determine when to turn on the switch to actuate the transmitter/control unit. However, if this is his first visit to the destination, he may turn on the switch while still a distance from his destination. By this action, he is able to identify the output sound of the receiver/sound generator unit. In addition, this would call the attention of passers-by to the user of this system and might be instrumental in securing the help of a stranger who would be willing to help the handicapped. The same applies to the destinations A and C. In utilizing the system for guiding the blind according to the invention, the receiver/sound generator units must be installed at the destinations the users wish to reach. If the destinations are the houses of the users themselves or their relative or friends, no difficulties should arise. However, if they were public institutions, cooperation of the person in charge must be secured. However, since the receiver/sound generator units are not particularly expensive, this cooperation could be readily obtained since everybody is ready to promote the welfare of the handicapped.

Figure 2:
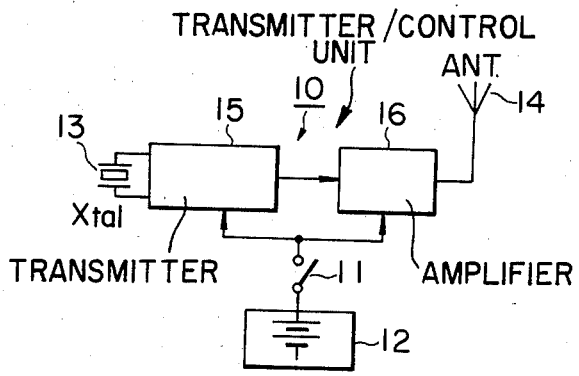
FIG. 2 is a block diagram of the transmitter/control unit of the guiding system according to the invention.

FIG. 2 is a block diagram of the transmitter/control unit 10 according to the invention, which is compact in size and light in weight so that it can be carried without any trouble. The transmitter/control unit 10 comprises a switch 11, a battery 12 turned on and off by means of the switch 11, a crystal oscillator 13 energized as the switch 11 is turned on to emit a radio control signal of a predetermined frequency in a continuous manner, and antenna 14 for sending the radio signal emitted by the crystal oscillator 13, a transmitter 15 and an amplifier 16. The transmitter 15 and amplifier 16 may comprise well known circuit elements, such as integrated circuits or large scale integrated circuits. The system could be used in large buildings i.e. shopping streets, as well as, government and private institutions, in addition to private homes. Thus, it is natural that the radio control signal used in the invention has a frequency in citizen's band and an output power in accordance with the relevant local law. Accordingly, the antenna used has an insulated wire of a length commensurate with the frequency of the control signal. In the embodiment shown and described herein, a radio control of a frequency in citizen band, such as 38.96 MHz was used with an output power of 2 mW. By using this signal, the system is capable of satisfactorily performing the function of guiding the blind to their destinations without any trouble. The continuous control signal used in the invention performs satisfactorily. The radio control signal may be modified to suit local conditions.

Figure 3:
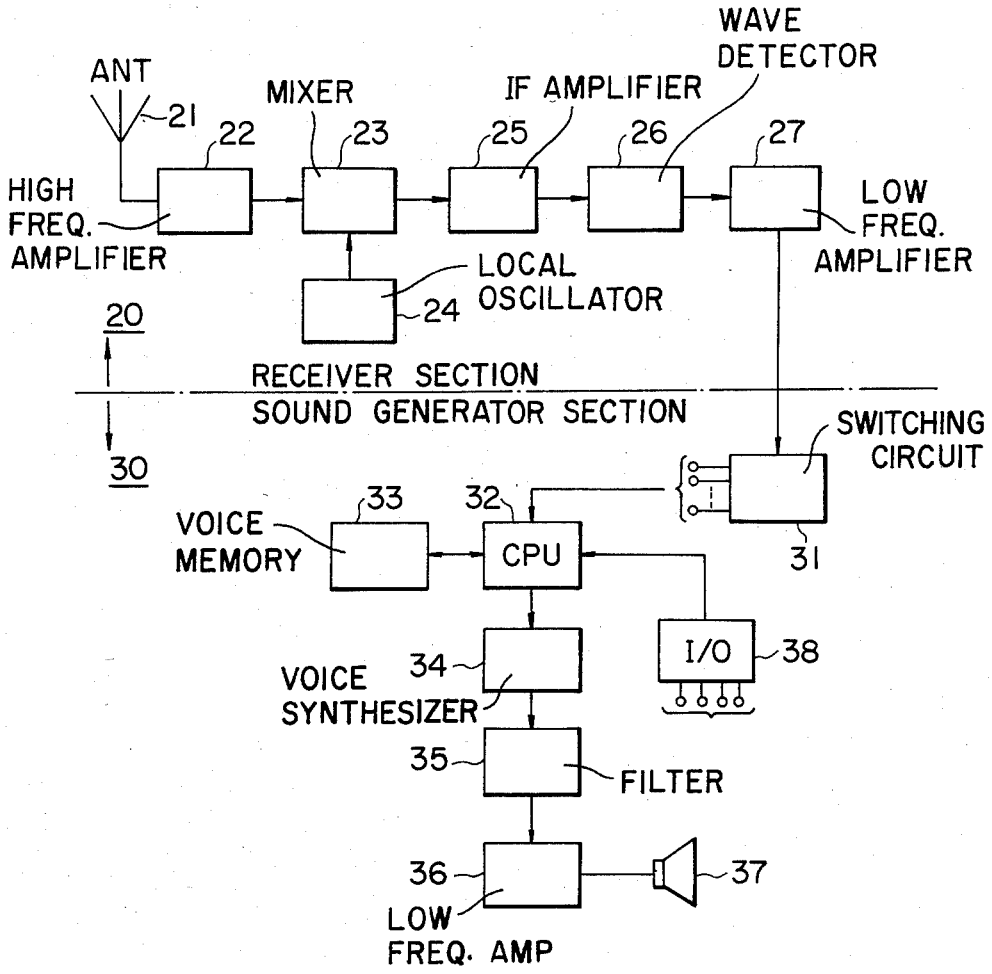
FIG. 3 is a block diagram of the receiver/sound generator unit of the guiding system according to the invention.

FIG. 3 is a block diagram of the receiver sound generator unit according to the invention. Since this unit is usually secured in place on a stationary object, there are no limits to its size and shape, unlike the transmitter/-control unit 10. However, this unit may be advantageously formed as a portable unit to enable it to be readily moved from one position to another when necessary.

The receiver/sound generator unit comprises a receiver section 20 located above a phantom line in FIG. 3, and a sound generator section 30 located below the phantom line. The receiver section 20 may be in the form of a known superhetrodyne receiver which receives through an antenna 21 a radio control signal from the transmitter/control 10 and amplifies it by a high frequency amplifier 22 before mixing it by a mixer 23. A local oscillator 24 is advantageously in the form of a crystal oscillator to stabilize the frequency. After being mixed, output control signal is passed through an intermediate frequency amplifier 25 and a wave detector 26 where the intermediate frequency signal converted to a low frequency signal. The low frequency control signal is amplified to a suitable level by a low frequency amplifier 27 while taking proper measures for avoiding a rise in noise level, before being inputted to the sound generator section 30 as a final control signal.

The sound generator section 30 comprises a switching circuit 31 receiving the final control signal from the receiver 20, and a central processing unit 32 actuated by an output of the switching circuit 31 to perform an operation. When the radio control signal used is a non-modulated continuous carrier wave, the switching circuit 31 is merely subjected to on-off control. However, when FSK or PM (frequency shifted keyed or pulse modulated) signals are used, more complicated control can be effected by combining these waves to produce a plurality of outputs.

The sound generator 30 further comprises a voice memory 33 which may be in the form of an EPROM selectively controlled by the central processing unit 32 which retrieves from the voice memory 33 signals corresponding to the desired audible signals. The data thus retrieved is passed by the central processing unit 32 to a voice synthesizing LSI 34, from which it is passed through a filter 35 and a low frequency amplifier 36 to a speaker 37 which produces a corresponding audible output. The central processing unit 32 may be controlled by an external interface. Thus, it is possible to select an operation mode for the sound generator 30 alone which may be required for testing the performance of the sound generator 30 or for using the system for special occasions.

The voide memory 33 and voice synthesizing LSI 34 can be made to store several sets of data corresponding to several digitized audible signals which may be selectively retrieved by the central processing unit 32. The output of the speaker 37 may be suitably adjusted to serve specific purposes and conditions, such as the place where the receiver/sound generator unit is located or the time of the day at which it is rendered operative.

The sound generator section 30 may also be in the form of a small recorder which uses a tape having necessary recorded contents or a sound generating mechanism suitable for generating chirping of some small birds, for example.

Accordingly, from the abovementioned description, it is noted that the guiding system for the blind will enable the user to (1) be guided positively in their travels, (2) reach their destinations in a shorter amount of time (3) eliminate uneasiness and anxiety of the user and (4) increase the user's safety. The system for guiding the blind according to the invention is quite useful for promoting the welfare of those who unhappily lost their eyesight.

What is claimed is:

1. A system for guiding a blind person to a preselected destination comprising:

at least one receiver/sound generator unit disposed at said destination including a sound generator storing data of a predetermined unique content, and a receiver receiving an electromagnetic control signal from outside to actuate said sound generator, said sound generator producing unique sounds indicative of said destination in response to said control signal; and a portable transmitter/control unit carried by said blind person for producing said electromagnetic control signal, upon activation by said blind person.

2. A system for guiding the blind as claimed in claim 1, wherein said sound generator comprises a recording and reproducing system for recording and reproducing the name or address of a place at which said receiver/-sound generator is installed.

3. A system for guiding the blind as claimed in claim 1, wherein said sound generator comprises a voice synthesizing circuit for recording and reproducing the name or address of a place at which said receiver/sound generator is installed.

4. A system for guiding the blind as claimed in claim 1, wherein said sound generator comprises an onomatopoeic sound generating system producing sound simulating chirping of some small birds.

* * * * *